US005897253A

United States Patent [19]

Ichikawa

[11] Patent Number: 5,897,253

[45] Date of Patent: Apr. 27, 1999

[54] DEVICE FOR MAKING A MASTER PLATE FOR PRINTING BRAILLE

[75] Inventor: Ryuji Ichikawa, Tokyo, Japan

[73] Assignee: Newlong Seimitsu Kogyo Co., Ltd., Tokyo, Japan

[21] Appl. No.: 08/960,261

[22] Filed: Oct. 29, 1997

[30] Foreign Application Priority Data

Nov. 15, 1996 [JP] Japan ..... 8-320716

[51] Int. Cl.[6] ..... B41J 3/32

[52] U.S. Cl. ..... 400/109.1; 434/114; 101/401.1

[58] Field of Search ..... 400/109.1, 129, 400/130, 636; 434/113, 114; 101/28, 16, 17, 32, 368, 401.1

[56] References Cited

U.S. PATENT DOCUMENTS

| | | | |
|---|---|---|---|
| 3,880,269 | 4/1975 | Carbonneau | 400/130 |
| 4,650,352 | 3/1987 | Eriksson | 400/109.1 |
| 4,653,942 | 3/1987 | Soloveychik et al. | 400/109.1 |
| 5,193,921 | 3/1993 | Tsukuda et al. | 400/109.1 |
| 5,205,662 | 4/1993 | Kurokawa et al. | 400/636 |
| 5,627,578 | 5/1997 | Weintraub | 347/101 |

*Primary Examiner*—Christopher A. Bennett
*Attorney, Agent, or Firm*—Rabin & Champagne, P.C.

[57] ABSTRACT

A device for making a master plate for printing braille includes a support table on which a master plate material is positionable. A punch is disposed on a first side of the master plate material. A punch die is positioned in alignment with the punch, and is arranged on a second side of the master plate material. A punch driver is connected to the punch, and is activateable to move the punch toward the master plate material. A shifter arrangement is provided for changing a relative position of the master plate material to the punch and the punch die. A controller is operatively connected to the shifter and the punch driver for controlling an operation of the shifter and the punch driver. A data supply arrangement is coupled to the controller, and supplies punching data thereto. The controller acts upon the punching data to cause the shifter to move the plate material relative to the punch and the punch die, and cause the punch driver to be actuated to punch the plate material at locations corresponding to raised braille dot positions.

26 Claims, 6 Drawing Sheets

DEVICE FOR MAKING A MASTER PLATE FOR PRINTING BRAILLE

CROSS REFERENCE TO RELATED PATENT APPLICATIONS

The subject matter of this application is related to co-pending application Ser. No. 08/960,262, filed Oct. 29, 1997, entitled "Method and Device for Printing Braille" by Ryuji ICHIKAWA, attorney docket number NAK-129, and Japanese Applications 8-320716, filed Nov. 15, 1996 and 8-357837, filed Dec. 27, 1996, the subject matter of which is incorporated herein by reference.

BACKGROUND OF THE INVENTION

The present invention relates to a device for making a master plate for printing braille. In particular, the present invention is directed toward a device for making a master plate for printing braille using inputted braille data.

Conventionally, a reusable master plate, capable of simultaneously printing a large number of braille characters, was made by etching a metal plate, such as a brass plate, using the process shown in FIG. 6. This etching process, however, required a special chemical liquid, special processing facilities, and a special processing technique. As such, the master plates were not easy to produce, and their manufacture was generally done by professionals. Further, the etching process disadvantageously produced harmful waste fluids, and required a long processing time.

However, demand for braille publications is increasing daily. As such, an easy-to-make master plate for printing braille has been needed. Such a master plate would facilitate the printing of braille. Thus, there is a need for a device for making a master plate, that does not require special knowledge or skills.

SUMMARY OF THE INVENTION

It is, therefore, a principal object of this invention to provide a device for making a master plate for printing braille.

It is another object of the invention to provide a device for making a master plate for printing braille that solves the above mentioned problems.

These and other objects of the present invention are accomplished by the device for making a master plate for printing braille disclosed herein.

According to one aspect of the invention, the device comprises a master plate fabrication device, which includes a support table on which a plate material is disposed. A punch, a punch die and a punch driver are provided. A shifter is used for changing the position of the plate material relative to the punch and the punch die. A controller is provided for controlling the shifter and the punch driver. A data supply device is used for supplying punching data, corresponding to the raised dot positions of the braille, to the controller. Relative movement occurs between the master plate material, and the punch and the punch die, so that the master plate can be punched with holes according to the punching data, to make the master plate. This device easily makes master plates, without requiring technical and professional expertise.

According to yet a further exemplary embodiment of the present invention, the shifter comprises a plate material shifter for moving the plate material in one direction, and a punch shifter for moving the punch and the punch die perpendicular to the direction of movement of the plate material.

The punch shifter includes a slider, which has an upper slider plate on which the punch and the punch driver are disposed, and a lower slider plate to which the punch die is mounted. The punch shifter further includes a ball thread having a linear moving element to which the slider is mounted, and a punch shifting motor for driving the ball thread.

The plate material shifter includes a pair of nip rollers that press against the surface of the plate material, and a plate material shifting motor for driving the nip rollers. The nip rollers are respectively mounted in front and rear of the punch shifter.

According to another exemplary embodiment of the present invention, the controller is adapted to actuate the punch driver twice at each braille dot position in the punching data. The data supply device comprises an input section, where the braille data is inputted, and a data conversion section, where the punching order is determined and the braille is converted into the punching data.

According to a further exemplary embodiment of the invention, the master plate can be comprised of resin. This will prevent the occurrence of burrs due to the punching process.

According to the invention, the master plate is made mechanically using a punching operation. Thus, anti-pollution measures, such as are required for an etching process, are eliminated. Further, the master plate can be quickly and easily made by anyone, without requiring special knowledge, skill or technique. Thus, the overall printing process is facilitated, thereby lowering production costs. This is advantageous to the blind, and may enhance a person's awareness of serving the blind.

DETAILED DESCRIPTION OF THE INVENTION

The invention will now be described in more detail by way of example with reference to the embodiments shown in the accompanying figures. The following described embodiments are only presented by way of example and should not be construed as limiting the inventive concept to any particular physical configuration.

Figure 1:
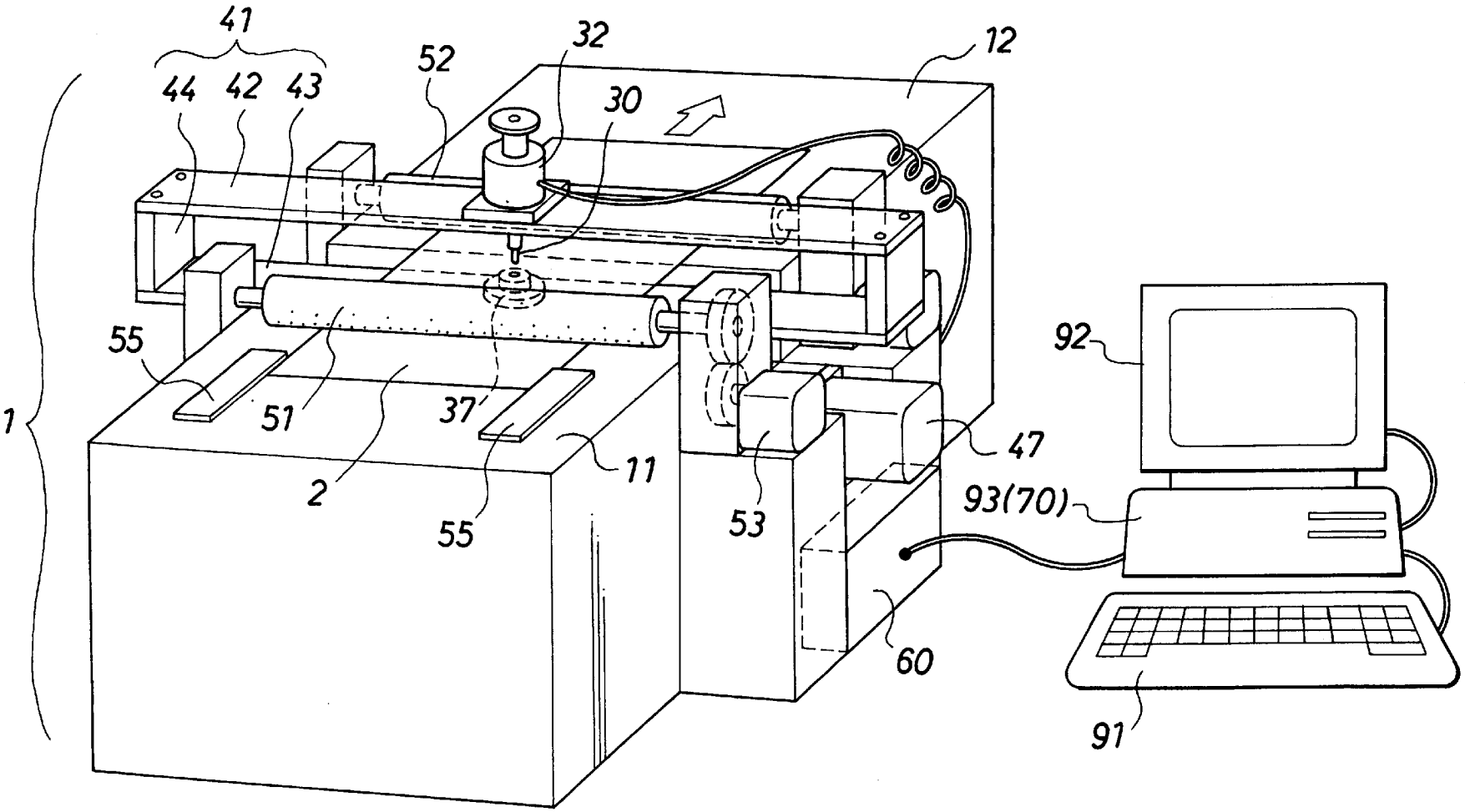
FIG. 1 is a perspective view of an exemplary embodiment of the present invention.
Figure 2:
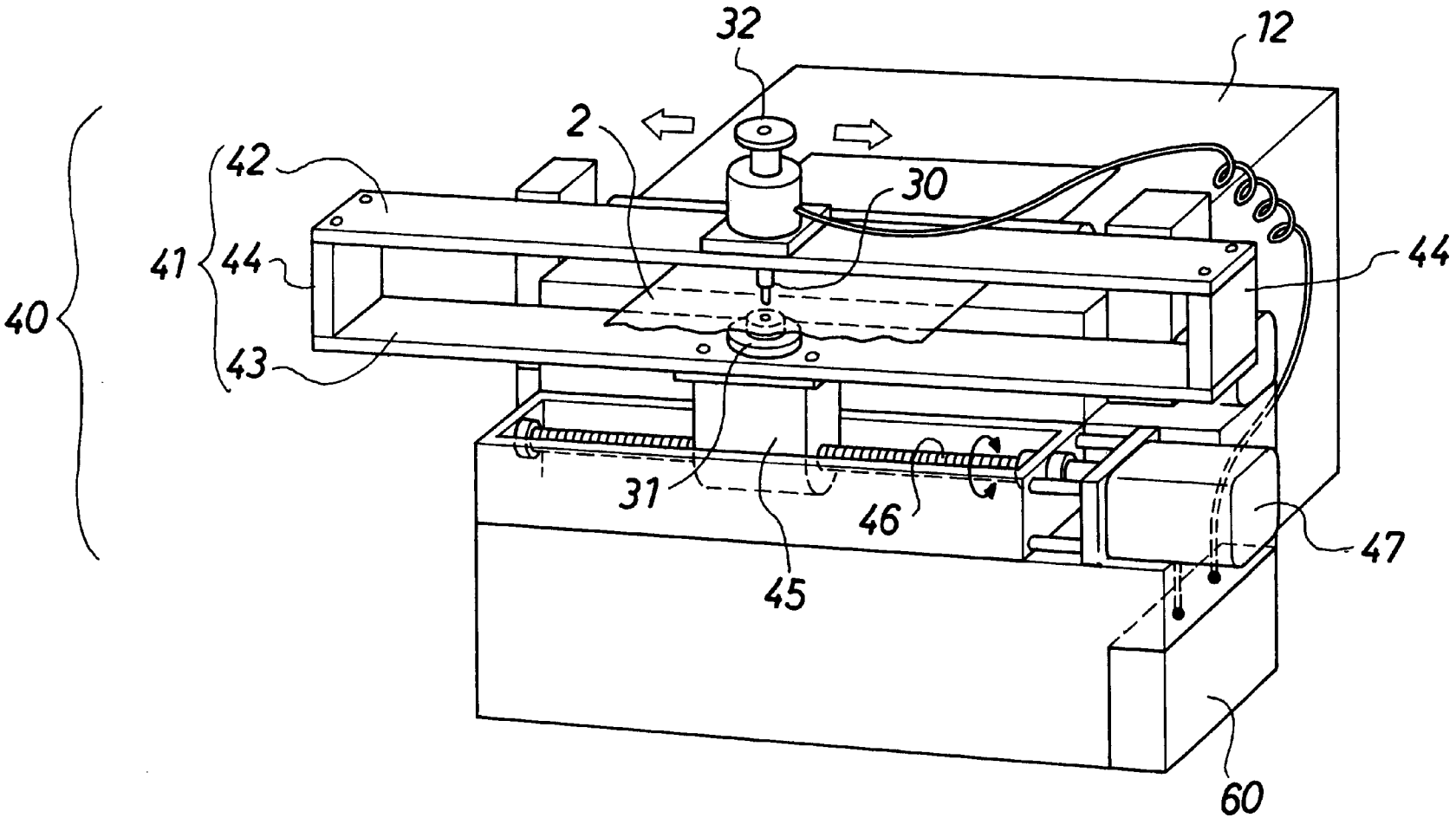
FIG. 2 is a perspective view of a punch shifter according to the present invention.
Figure 3:
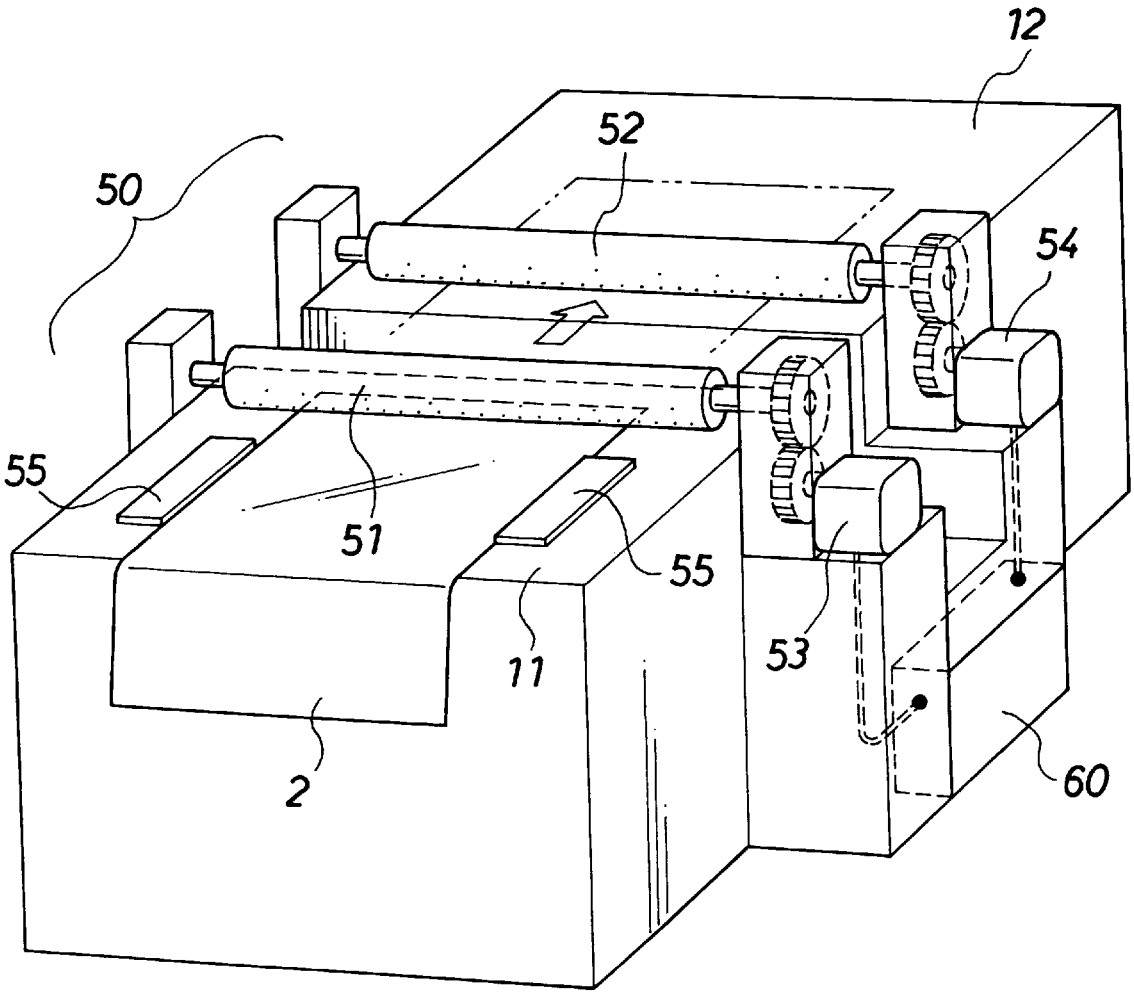
FIG. 3 is a perspective view of a master plate shifter according to the present invention.

Referring to FIGS. 1 to 3, a master plate fabrication device 1 is shown. The master plate fabrication device 1 includes a front base table 11, and a rear base table 12. The base tables 11 and 12 form a support table on which a master plate material 2 is disposed. The master plate fabrication device further includes a punch 30, a punch die 31, a punch driver 32 (which may be a solenoid), and a shifting arrangement that includes shifters 40 and 50.

Shifter 40 comprises a punch shifter, and is adapted to move punch 30 and punch die 31 in a direction perpendicular to a direction of movement of the plate material 2.

As best shown in FIG. 2, the punch shifter 40 includes a slider 41, that comprises an upper slider plate 42 and a lower slider plate 43. The punch 30 and the punch driver 32 are disposed on the upper slider plate 42, and the punch die 31 is mounted to the lower slider plate 43. The punch shifter 40 also includes a ball thread 46 having a linear moving element 45 connected thereto. The slider 41 is mounted on the linear moving element 45. A punch shifting motor 47 is provided for driving the ball thread 46. When ball thread 46 is driven, linear moving element is caused to move along a length of the ball thread 46, thus causing slider 41 to move.

The upper and lower slider plates 42 and 43 are parallel to each other, and are each provided at both ends with vertical frame elements 44. Vertical frame elements 44 connect the upper and lower slider plates 42, 43 together, to form slider 41 with a rectangular shape.

The punch 30 and the punch driver 32 are mounted at a center of the upper slider plate 42. The punch die 31 is mounted at a center of the lower slider plate 43. The punch 30 is aligned with the punch die 31, so that when the plate material 2 is fed between the punch 30 and the punch die 31, actuation of the punch driver 32 will cause the plate material 2 to be punched, and a hole to be formed therein.

The punch shifter 40 is provided between the front and rear base tables 11, 12, and is arranged close thereto, but not so close as to prevent the slider 41 from moving therebetween. Further, the upper surfaces of the base tables 11 and 12 are at the same level, so that the plate material 2 may be fed horizontally along the upper surfaces of base tables 11 and 12. Moreover, an upper end of the punch die 31 is disposed slightly lower than the upper surfaces of the base tables 11 and 12. This arrangement allows the plate material 2 to be fed from the front base table 11, between the punch 30 and the punch die 31, and onto the rear base table 12.

The horizontal moving range of the punch 30 (which is actuated by the punch driver 32) is determined by the moving range of the linear moving element 45 to which slider 41 is mounted. According to an exemplary embodiment, the linear moving element 45 will move essentially over a width of the base tables 11, 12. Therefore, punch 30 will move over the same range. To ensure that the plate material 2 will not come in contact with the vertical frame elements 44 when the slider 41 is at an extreme position, the slider 41 should be longer than the sum of a width of the plate material 2 together with the distance the linear moving element 45 can move. In the illustrated embodiment, the slider 41 is approximately twice as long as the width of the base tables 11, 12.

As best shown in FIG. 3, shifter 50 is a plate material shifter, and is adapted to move the plate material 2 in a longitudinal direction over the support table. The plate material shifter 50 comprises a front nip roller 51 provided on the front base table 11, and a rear nip roller 52 provided on the rear base table 12. Motors 53 and 54 are provided for rotating the respective nip rollers 51, 52.

As shown, the punch shifter 40 is interposed between the nip rollers 51, 52. In particular, the front and rear nip rollers 51, 52, are parallel to each other, and are respectively mounted in front and behind of the punch shifter 40.

Preferably, the front nip roller 51 is placed in contact with the upper surface of the front base table 11 toward the rear end thereof, while the rear nip roller 52 is placed in contact with the upper surface of the rear base table 12 toward the front end thereof. The nip rollers 51, 52 are connected to the motors 53 and 54, respectively, using, for example, connection gears, so as to be driven by the motors. Further, the nip rollers 51 and 52 may be rubber-lined to ensure the plate material 2 is moved along the surface of base tables 11, 12.

Alternatively, the rear nip roller 52 need not be driven by the motor 54, but instead may be caused to rotate using the movement of the plate material 2.

A pair of guide plates 55 may be provided in front of the front nip roller 51 on the front base table 11. The guide plates 55 are spaced apart, and are for aligning and guiding the plate material 2 to the nip rollers 51, 52.

A controller 60 is provided for controlling the shifters 40 and 50, and the punch driver 32. A data supply means 70 is provided which supplies master plate punching data **7*c* to the controller 60**.

The controller 60, which may be a micro computer, is electrically connected with the motors 47, 53 and 54, and with the punch driver 32, for controlling the motors and punch driver. The controller 60 can cause the punch driver 32 to be actuated twice at each braille position in response to punching data **7*c***.

Figure 4:
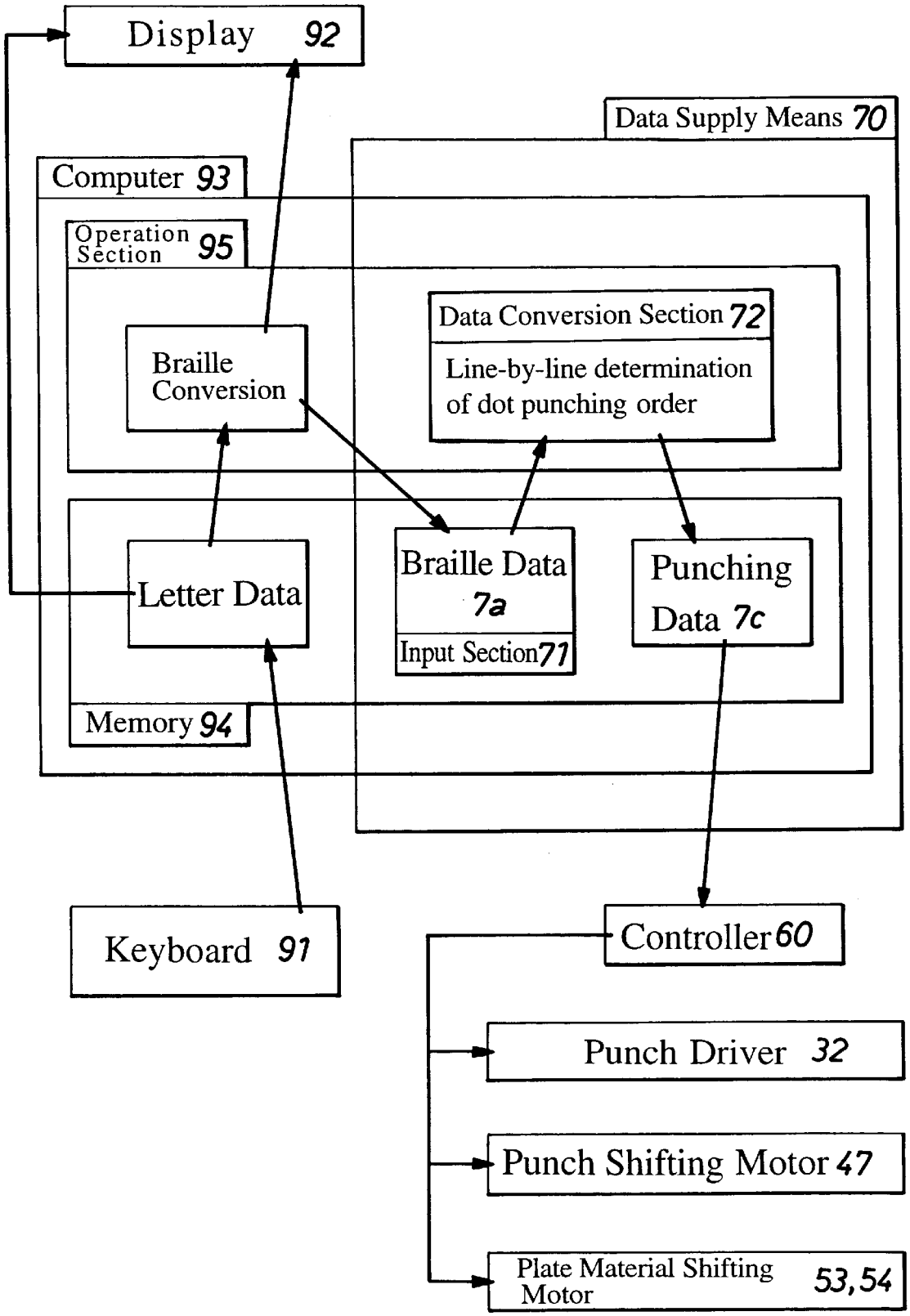
FIG. 4 is a schematic of a control system according to the present invention.

Referring to FIG. 4, the control system according to an exemplary embodiment is illustrated. In particular, the control system can include data supply means 70, which comprises an input section 71 for inputting braille data **7*a*, and a data conversion section 72 that receives the braille data 7*a* from the input section 71 and converts the braille data into punching data 7*c*, and that determines the punching order of the braille dots. The input section 71 is part of a memory 94 of a computer 93, and the data conversion section 72 is part of an operation section 95 of the computer 93**.

The braille data **7*a* is created by an arrangement that includes a keyboard 91 for inputting letters to be converted into braille, a display 92 for displaying the inputted letters, and the computer 93, which has a program for converting the inputted letters into braille data 7*a*. After conversion, the braille data is transmitted to input section 71**.

The operation of an exemplary embodiment will now be described. Letters to be converted into braille are inputted using the keyboard 92. A braille converting program of the computer 93 is activated to convert the letters into the braille data **7*a*, which is then stored in the memory 94 of the computer 93. Although this arrangement may be used to input the braille data 7*a* into the input section 71 of the data supply means 70, the braille data 7*a* may alternatively be created by another system, and subsequently inputted into the memory 94**.

As is known, one braille character is composed of six raised or non-raised dots, arranged in three lines and two columns. According to an exemplary embodiment, each line of braille characters to be printed is divided into an upper line, a middle line and a lower line. The invention punches the entire line of braille characters line by line, i.e., the upper line first, followed by the middle line, followed by the lower line, as opposed to punching each braille character separately.

Figure 5:
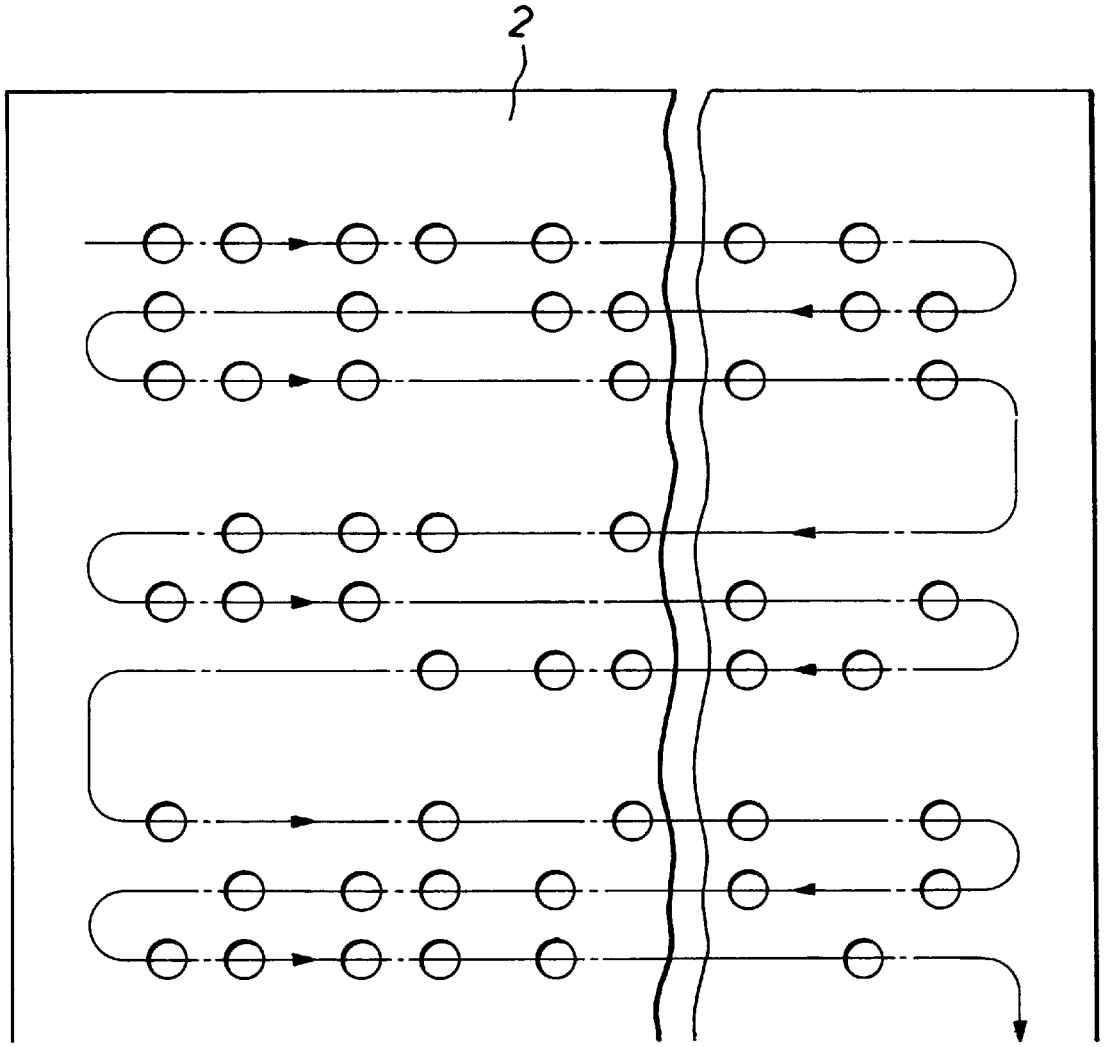
FIG. 5 illustrates a punching pattern of a plate material, according to the present invention.
Figure 6:
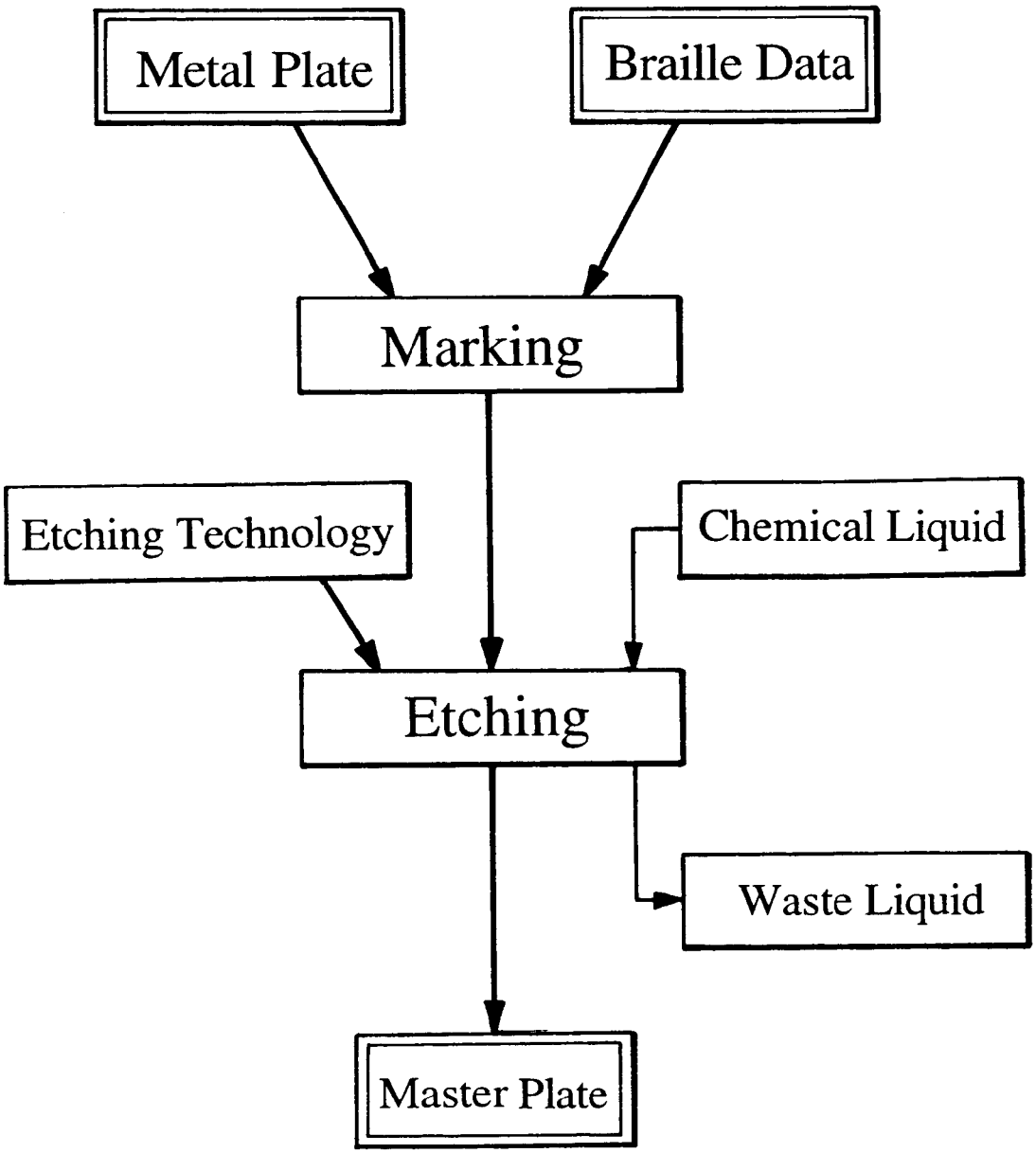
Fig. 6 Prior Art
FIG. 6 is a flow chart of a conventional process for making a master plate.

When the input section 71 is inputted with the braille data **7*a*, the operation section 95 of the computer 93, i.e. the data conversion section 72, sorts all of the dot positions of the braille data 7*a* into line-by-line dot data, and determines the punching order for each line, to create the punching data 7*c*. As shown in FIG. 5, the punching data 7*c* is such that the lines will be punched in alternating directions. Subsequently, the punching data 7*c* is supplied to the controller 60, which then acts upon the data to control the motors 47, 53, 54 and the punch driver 32**.

Meanwhile, the plate material 2 is placed in position between the guide plates 55 on the front base table 11, with the foremost end of the plate material 2 being caught by the front nip roller 51. When the control section 60 actuates the motor 53, the front nip roller 51 rotates and consequently moves the plate material 2 along the guide plates 55 toward the rear nip roller 52. The plate material 2 passes between the punch 30 and the punch die 31, and is moved toward the rear base table 12 and the rear nip roller 52. Upon reaching the rear nip roller 52, the plate material 2 is caught by the rear nip roller 52, which may be driven by the motor 54, so that the plate material 2 is now transferred by both nip rollers 51, 52.

Further, the controller 60 actuates motor 47 to rotate ball thread 46, thereby causing the linear moving element 45 to move linearly. The punch 30 and the punch die 31 of the slider 41 move linearly with the linear moving element 45.

When the punch 30 is shifted to a dot position, the controller 60 actuates the punch driver 32 to punch the plate material 2. The controller 60 is adapted to drive the punch driver 32 twice at the same position, thus ensuring a hole is formed in the plate material 2, while eliminating any burrs that may otherwise occur.

Punching of the plate material 2 is performed using the controller 60, which stops and starts the motors 47, 53, 54, and repeatedly actuates the punch driver 32. As shown in FIG. 5, the dots of each braille character are converted into three lines of dot position data, with the punching order being determined line by line. As previously noted, the lines are punched in alternating punching directions. As such, two lines of dots can be punched during one reciprocating movement of the punch 30, thereby reducing the time needed to fabricate the master plate. Further, the nip rollers 51, 52 will not need to be rotated in a reverse direction, which helps stabilize the movement of the plate material 2. Moreover, comprising the punch shifter 40 of the ball thread 46 helps reduce backlash.

The plate material 2 may be comprised of a resin, such as a polyester film. Polyester film advantageously can be punched without the formation of burrs, and allows for an effective transfer of the ink during the printing process. Further, the nip rollers have proven to be very suitable for moving a material plate comprised of resin, especially if the nip rollers are disposed in front and behind of the punch.

When the master plate is fabricated according to the present invention, and is used in a braille printer with a highly viscous ink, the ink will be deposited with a thick, round shape. Once dried, the ink will form raised dots arranged in the pattern of braille characters.

It should be understood, however, that the invention is not necessarily limited to the specific arrangement and components shown and described above, but may be susceptible to numerous variations within the scope of the invention.

It will be apparent to one skilled in the art that the manner of making and using the claimed invention has been adequately disclosed in the above-written description of the preferred embodiments taken together with the drawings. It will be understood that the above description of the preferred embodiments of the present invention is susceptible to various modifications, changes, and adaptations, and the same are intended to be comprehended within the meaning and range of equivalents of the appended claims.

What is claimed is:

1. A device for making a master plate for printing braille, comprising:

a support table on which a master plate material is positionable;

a punch disposed to be on a first side of the master plate material;

a punch die positioned in alignment with said punch, and arranged to be on a second side of the master plate material;

a punch driver connected to said punch, and being activateable to move said punch toward said punch die;

a shifter arrangement being activatable for changing a relative position of the master plate material to said punch and said punch die, and comprising:

a plate material shifter engageable with the master plate material for moving the master plate material in a linear direction; and a punch shifter connected with said punch and said punch die for moving said punch and said punch die perpendicular to the linear direction of movement of the master plate material, said punch shifter comprising:

a slider arrangement having an upper slider plate to which said punch and said punch driver are mounted, and a lower slider plate to which said punch die is mounted;

a ball thread having a linear moving element connected thereto, said slider arrangement being mounted to said linear moving element; and a punch shifting motor operatively connected to said ball thread for driving said ball thread;

a controller operatively connected to said shifter arrangement and said punch driver for controlling an operation of said shifter arrangement and said punch driver; and a data supply system coupled to said controller, and supplying punching data corresponding to braille dot positions to said controller, whereby said controller acts upon the punching data to cause said shifter arrangement to effect a relative movement between the plate material, and said punch and said punch die, and cause said punch driver to be actuated to punch the plate material at the corresponding braille dot positions.

2. The device recited in claim 1, wherein said data supply system comprises an input section for inputting braille data, and a data conversion section coupled with said input section and receiving the braille data therefrom, said data conversion section determining a dot punching order, and converting the braille data into the punching data.

3. The device recited in claim 1, wherein said controller causes said punch driver to be actuated twice at each corresponding braille dot position.

4. The device recited in claim 3, wherein said data supply system comprises an input section for inputting braille data, and a data conversion section coupled with said input section and receiving the braille data therefrom, said data conversion section determining a dot punching order, and converting the braille data into the punching data.

5. The device recited in claim 1, wherein said plate material shifter comprises:

a plurality of nip rollers, each being arranged over a surface of said support table so that when the plate material is on said support table, said nip rollers contact a surface of the plate material; and a plate material shifting motor operatively coupled with at least one of said nip rollers for driving said nip rollers.

6. The device recited in claim 5, wherein said data supply system comprises an input section for inputting braille data, and a data conversion section coupled with said input section and receiving the braille data therefrom, said data conversion section determining a dot punching order, and converting the braille data into the punching data.

7. The device recited in claim 5, wherein said controller causes said punch driver to be actuated twice at each corresponding braille dot position.

8. The device recited in claim 7, wherein said data supply system comprises an input section for inputting braille data, and a data conversion section coupled with said input section and receiving the braille data therefrom, said data conversion section determining a dot punching order, and converting the braille data into the punching data.

9. The device recited in claim 5, wherein said plurality of nip rollers include a first nip roller mounted in front of said punch shifter, and a second nip roller mounted behind said punch shifter.

10. The device recited in claim 9, wherein said data supply system comprises an input section for inputting braille data, and a data conversion section coupled with said input section and receiving the braille data therefrom, said data conversion section determining a dot punching order, and converting the braille data into the punching data.

11. The device recited in claim 9, wherein said controller causes said punch driver to be actuated twice at each corresponding braille dot position.

12. The device recited in claim 11, wherein said data supply system comprises an input section for inputting braille data, and a data conversion section coupled with said input section and receiving the braille data therefrom, said data conversion section determining a dot punching order, and converting the braille data into the punching data.

13. The device recited in claim 1, wherein said plate material shifter comprises:

a plurality of nip rollers, each being arranged over a surface of said support table so that when the plate material is on said support table, said nip rollers contact a surface of the plate material; and a plate material shifting motor operatively coupled with at least one of said nip rollers for driving said nip rollers.

14. The device recited in claim 13, wherein said plurality of nip rollers include a first nip roller mounted in front of said punch shifter, and a second nip roller mounted behind said punch shifter.

15. The device recited in claim 14, wherein said controller causes said punch driver to be actuated twice at each corresponding braille dot position.

16. The device recited in claim 15, wherein said data supply system comprises an input section for inputting braille data, and a data conversion section coupled with said input section and receiving the braille data therefrom, said data conversion section determining a dot punching order, and converting the braille data into the punching data.

17. The device recited in claim 14, wherein said data supply system comprises an input section for inputting braille data, and a data conversion section coupled with said input section and receiving the braille data therefrom, said data conversion section determining a dot punching order, and converting the braille data into the punching data.

18. The device recited in claim 13, wherein said controller causes said punch driver to be actuated twice at each corresponding braille dot position.

19. The device recited in claim 18, wherein said data supply system comprises an input section for inputting braille data, and a data conversion section coupled with said input section and receiving the braille data therefrom, said data conversion section determining a dot punching order, and converting the braille data into the punching data.

20. The device recited in claim 13, wherein said data supply system comprises an input section for inputting braille data, and a data conversion section coupled with said input section and receiving the braille data therefrom, said data conversion section determining a dot punching order, and converting the braille data into the punching data.

21. The device recited in claim 1, wherein said controller causes said punch driver to be actuated twice at each corresponding braille dot position.

22. The device recited in claim 21, wherein said data supply system comprises an input section for inputting braille data, and a data conversion section coupled with said input section and receiving the braille data therefrom, said data conversion section determining a dot punching order, and converting the braille data into the punching data.

23. The device recited in claim 1, wherein said data supply system comprises an input section for inputting braille data, and a data conversion section coupled with said input section and receiving the braille data therefrom, said data conversion section determining a dot punching order, and converting the braille data into the punching data.

24. The device recited in claim 1, wherein said controller causes said punch driver to be actuated twice at each corresponding braille dot position.

25. The device recited in claim 24, wherein said data supply system comprises an input section for inputting braille data, and a data conversion section coupled with said input section and receiving the braille data therefrom, said data conversion section determining a dot punching order, and converting the braille data into the punching data.

26. The device recited in claim 1, wherein said data supply system comprises an input section for inputting braille data, and a data conversion section coupled with said input section and receiving the braille data therefrom, said data conversion section determining a dot punching order, and converting the braille data into the punching data.

* * * * *